US006814133B2

(12) United States Patent
Yamaguchi

(10) Patent No.: US 6,814,133 B2
(45) Date of Patent: Nov. 9, 2004

(54) HEAT EXCHANGER FOR COOLING OIL WITH WATER

(75) Inventor: Takeshi Yamaguchi, Kanagawa (JP)

(73) Assignee: Calsonic Kansei Corporation, Tokyo (JP)

( * ) Notice: Subject to any disclaimer, the term of this patent is extended or adjusted under 35 U.S.C. 154(b) by 132 days.

(21) Appl. No.: 10/097,103

(22) Filed: Mar. 14, 2002

(65) Prior Publication Data

US 2002/0129926 A1 Sep. 19, 2002

(30) Foreign Application Priority Data

Mar. 16, 2001 (JP) ..... 2001-075468

(51) Int. Cl.[7] ..... F28F 3/00

(52) U.S. Cl. ..... 165/41; 165/167; 165/916; 123/196 A; 123/196 B

(58) Field of Search ..... 165/167, 916; 123/196 A, 196 B

(56) References Cited

U.S. PATENT DOCUMENTS

| | | | | | |
|---|---|---|---|---|---|
| 4,011,905 | A | * | 3/1977 | Millard | 165/175 |
| 5,464,056 | A | * | 11/1995 | Tajima et al. | 165/167 |
| 5,511,612 | A | * | 4/1996 | Tajima et al. | 165/167 |
| 5,513,702 | A | * | 5/1996 | Tajima et al. | 165/167 |
| 5,544,699 | A | * | 8/1996 | Robers et al. | 165/283 |
| 5,558,154 | A | * | 9/1996 | Lefeber | 165/51 |
| 5,797,450 | A | * | 8/1998 | Kawabe et al. | 165/167 |
| 5,810,071 | A | * | 9/1998 | Pavlin | 165/284 |
| 5,931,219 | A | * | 8/1999 | Kull et al. | 165/51 |
| 5,964,283 | A | * | 10/1999 | Pavlin | 165/167 |
| 6,161,615 | A | * | 12/2000 | Brieden et al. | 165/166 |
| 6,340,054 | B1 | * | 1/2002 | Schwarz et al. | 165/167 |
| 6,427,768 | B2 | * | 8/2002 | Komoda et al. | 165/145 |
| 2001/0025704 | A1 | | 10/2001 | Jainek | |

FOREIGN PATENT DOCUMENTS

| | | | | |
|---|---|---|---|---|
| DE | 93 09 741 U1 | | 8/1993 | |
| DE | 195 19 740 A1 | | 12/1996 | |
| EP | 1 124 105 A2 | | 8/2001 | |
| GB | 2 270 971 A | | 3/1994 | |
| JP | 62-005092 A | | 1/1987 | |
| JP | 2-270971 A | * | 3/1994 | F28D/9/00 |
| JP | 7-286786 | | 10/1995 | |
| JP | 07-286786 | * | 10/1995 | F28D/9/00 |

* cited by examiner

*Primary Examiner*—Henry Bennett
*Assistant Examiner*—Nihir Patel
(74) *Attorney, Agent, or Firm*—Foley & Lardner LLP

(57) ABSTRACT

A heat exchanger for cooling oil with water includes (a) oil and water chambers alternately arranged to form a core portion; (b) a through hole formed in the core portion to allow an oil flow therethrough; (c) first and second oil passages communicating with the oil chambers; (d) a blocking plate for blocking a part of these oil passages; and (e) a cover member covering one side of the core portion. The through hole has one end as one of oil inlet and outlet, and the first oil passage has one end as the other. The cover member has an oil passage extending between the other end of the through hole and at least one of the other end of the first oil passage and an end of the second oil passage.

17 Claims, 7 Drawing Sheets

HEAT EXCHANGER FOR COOLING OIL WITH WATER

BACKGROUND OF THE INVENTION

The present invention relates to a heat exchanger (oil cooler) for cooling oil with water and particularly to a so-called housing-less type oil cooler formed by stacking plate members together.

Japanese Patent Unexamined Publication JP-A-7-286786 discloses such housing-less type heat exchanger (oil cooler), as shown in FIGS. 6–8 of the present application. As shown in FIG. 6, this heat exchanger has a core portion 51. This core portion 51 is reinforced with upper and lower reinforcing plates 53, 55 (made of aluminum). The upper reinforcing plate 53 is covered with a cover member 57, and a void space 59 is provided between the cover member 57 and the upper reinforcing member 53. A collar member 63 is disposed at a central portion of the core portion 51 for receiving an attaching bolt 61 therethrough. An attaching member 65 is disposed under the lower reinforcing plate 55 for attaching the heat exchanger to an automatic transmission. As shown in FIG. 7, each of the upper reinforcing plate 53 and the cover member 57 is provided with through holes for receiving therethrough a cooling water inlet pipe 67 and a cooling water outlet pipe 69. The core portion 51 is formed of first and second plates 71 and 73 (made of aluminum having thereon a cladding of a brazing material) alternately stacked together such that cooling water chambers 75 and oil chambers 77 are alternately formed between these plates 71, 73. As shown in FIG. 6, adjacent oil chambers 77 are communicated with each other through a pair of oil passages 79*a* and 79*b*, which are symmetrically arranged about the collar member 63 disposed at the central portion. Furthermore, inner fins 81 are received in the oil chambers 77. In contrast, as shown in FIG. 7, adjacent water chambers 75 are communicated with each other through a pair of cooling water passages 83, which are symmetrically arranged about the collar member 63. The oil passages 79*a* and 79*b* are partly blocked by blocking plates 71A, 73A. As shown in FIG. 6, an oil inlet pipe 85 is inserted deep in the core portion 51 by passing it from a first side (the side of the cover member 57) through the cover member 57, the upper reinforcing plate 53, the 9 oil passage 79*a* and the blocking plates 71A and 73A. The oil inlet pipe 85 is formed with upper and lower projections 85*a* and 85*b*. The upper projection 85*a* is brazed to the cover member 57 to sealingly close the through hole of the cover member 57. The lower projection 85*b* is sealingly brazed to the blocking plate 71A. The oil inlet pipe 85 has a diameter that is substantially smaller than that of the oil passage 79*a*, except at the position of the blocking plates 71A and 73A, such that an annular space is provided between the oil inlet pipe 85 and the outer periphery of the oil passage 79*a*. The oil is allowed to flow through the annular space as shown by the arrows of FIG. 6. An oil outlet pipe 87 is inserted in the core portion 51 by passing it through the cover member 57 and the upper reinforcing plate 53. The oil outlet pipe 87 is formed with (a) a projection 87*a* sealingly brazed to the cover member 57 and (b) and an end sealingly brazed to the upper reinforcing plate 53. As shown in FIG. 6, the oil is introduced into a lower portion of the core portion 51 from the oil inlet pipe 85. Then, it is allowed to flow in the core portion 51 in a meandering manner by the provision of the blocking plates 71A and 73A, as shown by the arrows of FIG. 6. After that, it is allowed to flow out of the core portion 51 into the oil outlet pipe 87. In contrast, as shown in FIG. 7, the cooling water is introduced into the core portion 51 from the cooling water inlet pipe 67. Then, it is allowed to flow through cooling water passages 83. Each cooling water chamber 75 is filled with the cooling water, thereby conducting a heat exchange between the heated oil and the cooling water. After this heat exchange, the water is allowed to flow into the cooling water outlet pipe 69 from the core portion 51. As shown in FIG. 8, the heat exchanger 99 is attached to an automatic transmission 91. In fact, this transmission 91 is formed with threaded projections 93. An attaching base 95 is fixed to the threaded projections 93 by threadedly engaging bolts 97 with the threaded projections 93. The attaching base 95 is formed at center with a threaded hole 95*a*. The attaching bolt 61 is inserted into the collar member 63 of the core portion 51 and then threadedly engaged with the threaded hole 95*a*, thereby attaching the heat exchanger 99 to the automatic transmission 91. Furthermore, oil inlet and outlet pipes 101 and 103 of the transmission 91 are respectively connected with the oil inlet and outlet pipes 85 and 87 of the heat exchanger 99. It is possible to turn the oil flow direction by the provision of the blocking plates 71A and 73A. As mentioned above, the oil inlet pipe 85 is inserted deep in the core portion 51 in order to achieve an oil flow in a meandering manner. This makes the heat exchanger's piping structure very complicated.

SUMMARY OF THE INVENTION

It is therefore an object of the present invention to provide a heat exchanger that is capable of achieving an oil flow in a meandering manner without inserting a pipe member deep in a core portion of the heat exchanger.

It is another object of the present invention to provide a heat exchanger that is capable of providing a superior heat exchange between oil and cooling water with a relatively small number of parts and a relatively simple construction.

According to the present invention, there is provided a heat exchanger for cooling oil with water, comprising:

a plurality of plates stacked together to form a core portion of said heat exchanger such that a plurality of oil chambers for receiving the oil and a plurality of water chambers for receiving the water are alternately formed between said plates, said water chambers being communicated with each other through first and second water passages;

a first wall portion for defining a through hole in said core portion, said through hole allowing the oil to flow therethrough and having first and second ends at first and second sides of said core portion respectively, said first end being one of an inlet for allowing the oil to flow into said core portion and an outlet for allowing the oil to flow out of said core portion;

a second wall portion for defining a first oil passage in said core portion, said first oil passage extending between said first and second sides of said core portion to communicate with said oil chambers, said first oil passage having first and second ends at said first and second sides of said core portion respectively, said first end of said first oil passage being the other of said inlet and said outlet;

a third wall portion for defining a second oil passage in said core portion, said second oil passage extending between said first and second sides of said core portion to communicate with said oil chambers; said second oil passage having first and second ends at said first and second sides of said core portion respectively, a first blocking plate for blocking a part of said first and second oil passages such that a flow of the oil is turned from one of said first and second oil passages to the other of said first and second oil passages; and a first cover member for sealingly covering said second side of said core portion, said first cover member having an oil passage extending between said second end of said through hole and at least one of said second end of said first oil passage and said second end of said second oil passage.

DETAILED DESCRIPTION

With reference to FIGS. 1–4, a first heat exchanger according to a first embodiment of the present invention will be described in detail in the following. This heat exchanger is a so-called housing-less type oil cooler.

Figure 1:
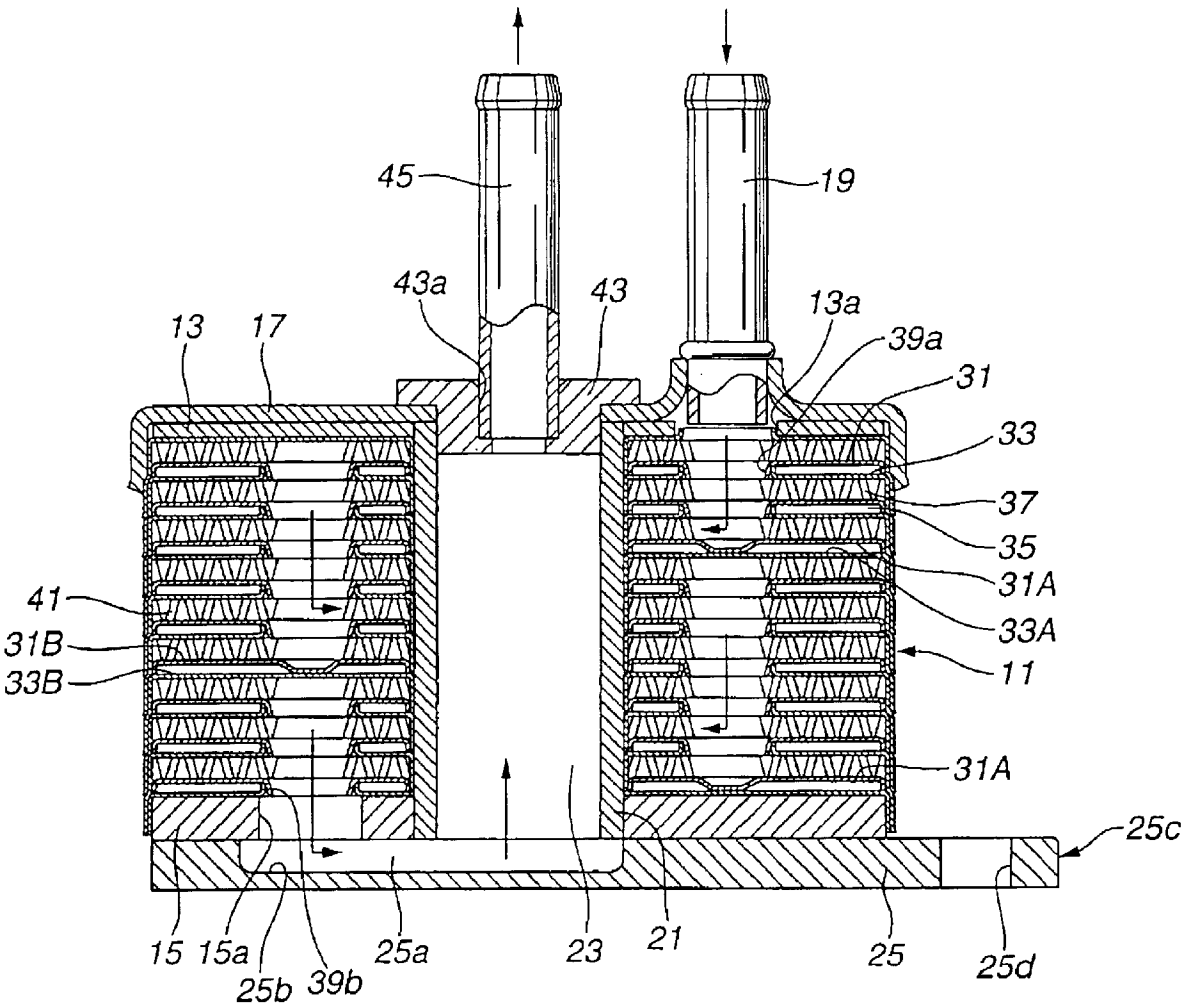
FIG. 1 is a sectional view showing a first heat exchanger according to a first embodiment of the present invention, taken along the lines 1—1 of FIG. 3.

As shown in FIG. 1, the first heat exchanger has a core portion 11 disposed between upper and lower reinforcing plates (made of aluminum) 13 and 15. The upper reinforcing plate 13 is covered with and brazed to a cover member 17. The cover member 17 serves to cover a first side of the core portion 11. The cover member 17 has an opening for receiving an oil inlet pipe 19 for introducing oil into the core portion 11. Furthermore, the upper reinforcing plate 13 also has an opening 13*a* at a position corresponding to the oil inlet pipe 19.

Figure 2:
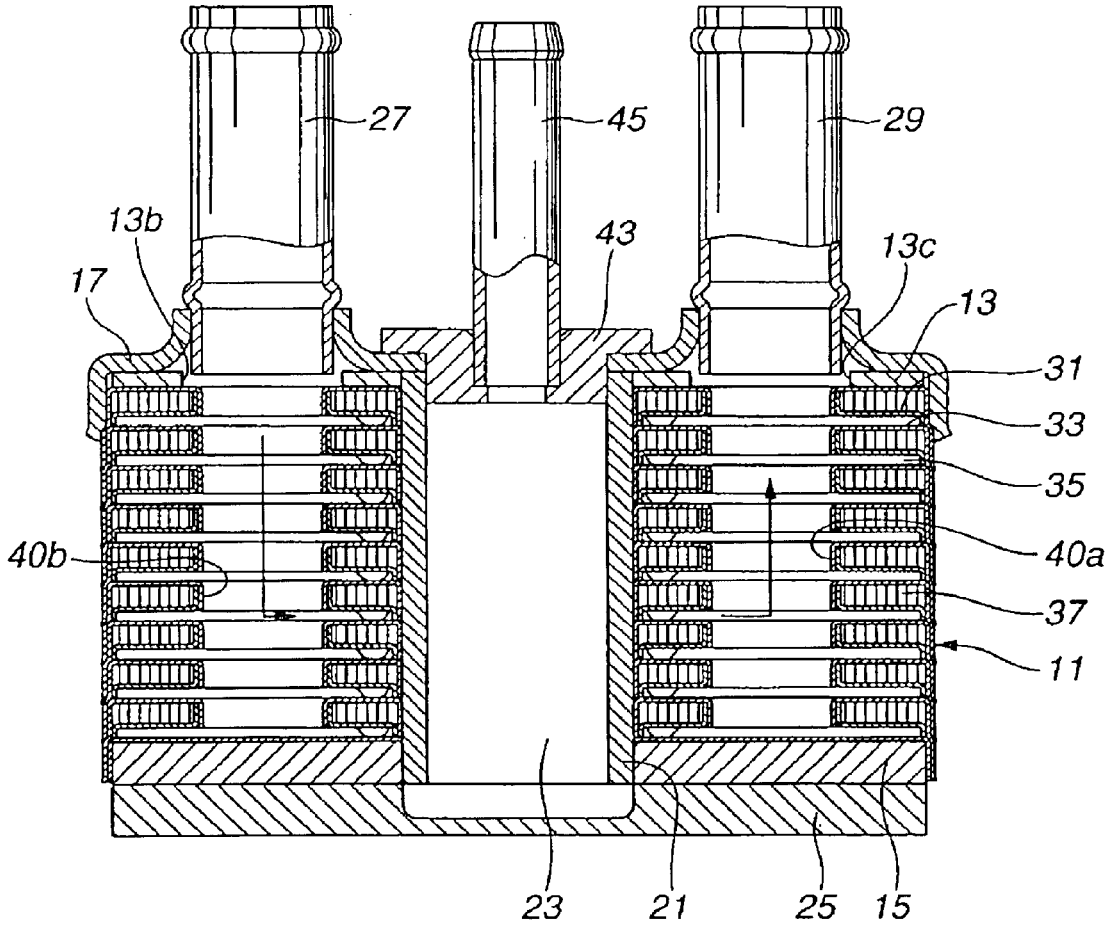
FIG. 2 is a sectional view showing the first heat exchanger, taken along the lines 2—2 of FIG. 3.

The first heat exchanger has a cylindrical reinforcing member 21 at a central portion of the core portion 11 for reinforcing structure of the core portion 11, thereby providing a through hole 23 allowing an oil flow therethrough. Another cover member 25 is brazed to the bottom surface of the lower reinforcing plate 15 for sealingly covering a second side of the core portion 11. Furthermore, as shown in FIG. 2, the cover member 17 has respective openings for receiving cooling water inlet and outlet pipes 27 and 29. The upper reinforcing plate 13 is also formed with through holes 13*b* and 13*c* at positions respectively corresponding to the cooling water inlet and outlet pipes 27 and 29.

The core portion 11 is formed of first and second plates 31 and 33 alternately stacked together such that a plurality of water chambers 35 for receiving the cooling water and a plurality of oil chambers 37 for receiving the oil are alternately formed between these plates 31 and 33. These plates 31 and 33 are each made of an aluminum having thereon a cladding of a brazing material.

As shown in FIG. 1, adjacent oil chambers 37 are communicated with each other through a pair of first and second oil passages 39*a* and 39*b*, which are symmetrically arranged about the reinforcing member 21. In fact, one water chamber 35 is sandwiched, together with these first and second oil passages, between these adjacent oil chambers 37. Furthermore, an inner fin 41 is received in each oil chamber 37. In contrast, as shown in FIG. 2, adjacent water chambers 35 are communicated with each other through a pair of first and second water passages 40*a* and 40*b*, which are also symmetrically arranged about the reinforcing member 21. In fact, one oil chamber 37 is sandwiched, together with these first and second water passages 40*a* and 40*b*, between these adjacent water chambers 35. Each first plate 31 may have first and second cylindrical flanges respectively defining the first and second oil passages 39*a* and 39*b*. Each second plate 33 may also have first and second cylindrical flanges respectively defining the first and second water passages 40*a* and 40*b*.

As shown in FIG. 1, the first and second plates 31 and 33 may be partly not provided with their openings to block the first oil passage 39*a*. Thus, such first and second plates 31 and 33 can serve as a first blocking plate 31A and 33A. For example, when the oil is introduced into the core portion 11 through the oil inlet pipe 19, the oil is allowed to flow through the first oil passage 39*a* in a downward direction in FIG. 1. Then, the oil is allowed to turn left in FIG. 1 at the first blocking plate 31A and 33A, then to pass around the cylindrical reinforcing member 21 toward the second oil passage 39*b*, and then to flow in a downward direction in FIG. 1 through the second oil passage 39*b*. Therefore, the provision of the first blocking plate 31A and 33A makes it possible to achieve an oil flow in a meandering manner in the core portion 11. This provides a superior heat exchange between heated oil and cooling water. Similar to the first blocking plate 31A and 33A, the core portion 11 has a second blocking plate 31B and 33B for blocking the second oil passage 39*b*. The second blocking plate has a function similar to that of the first blocking plate, thereby achieving an oil flow in a meandering manner in the core portion 11.

As shown in FIG. 1, the core portion 11 is respectively formed at its first and second sides with (a) a cap member 43 for sealingly closing an end opening of the through hole 23 and (b) a cover member 25 for sealingly closing the other end opening of the through hole 23. The cap member 43 (made of aluminum) is sealingly brazed to the cover member 17. The cover member 25 (made of aluminum) is sealingly brazed to the lower reinforcing plate 15. The cap member 43 is formed with a through hole 43*a* for connecting the oil outlet pipe 45 thereto. The cover member 25 is provided on its inner surface with an oil passage (oil turning passage) 25*a* by forming a depression 25*b*. This oil passage 25*a* communicates with and extends between the second oil passage 39*b* and the through hole 23. Therefore, it is possible to provide an oil flow from the lower end of the second oil passage 39*b* into the through hole 23 through the oil passage 25*a* (see the arrows of FIG. 1) and vice versa.

Figure 3:
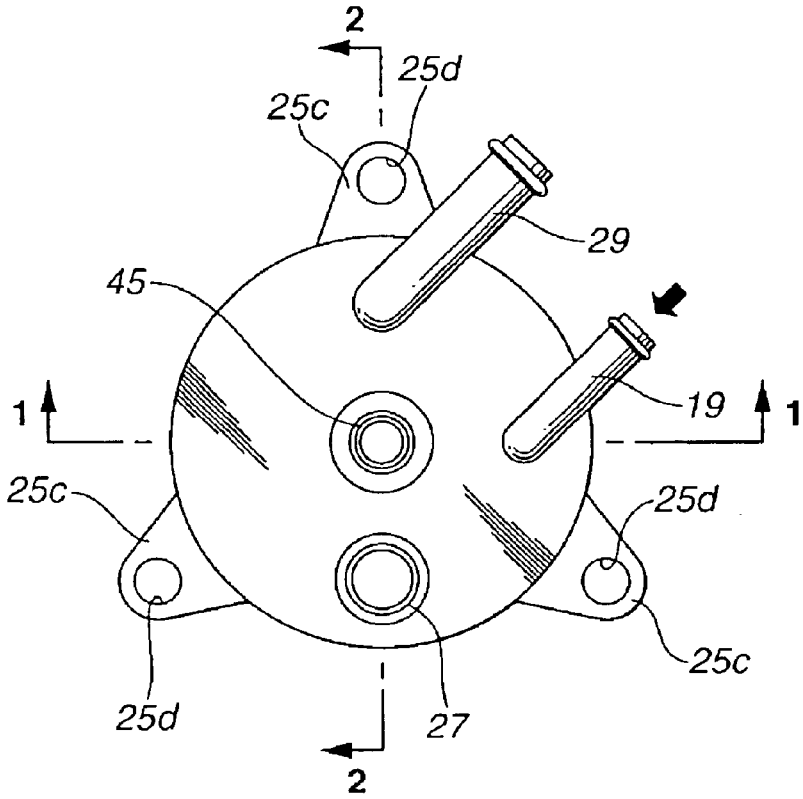
FIG. 3 is a front view showing the first heat exchanger.
Figure 4:
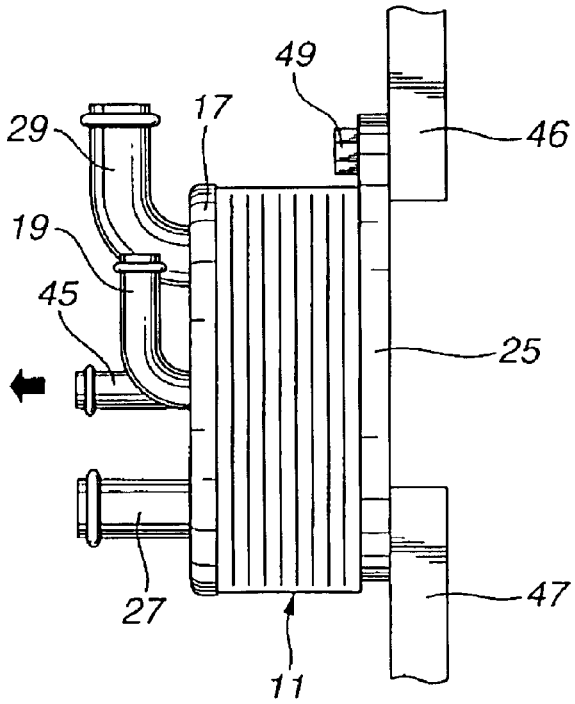
FIG. 4 is a side view showing a condition in which the first heat exchanger is attached to another member.

As shown in FIGS. 1, 3 and 4, the cover member 25 is monolithically formed with three attaching portions 25*c* with an angle of 120 degrees between adjacent two attaching portions 25*c*. Each attaching portion 25*c* is formed with a through hole 25*d* for receiving a bolt 49 therethrough. For example, as shown in FIG. 4, the first heat exchanger can be attached by the bolts 49 to other members 46 and 47, which are arranged to have a space therebetween in a vertical direction in an automotive engine compartment.

Parts for forming the first heat exchanger are previously coated with an anticorrosive flux, followed by drying. Then, these parts are assembled together, followed by heating in a furnace to braze the parts, thereby producing the first heat exchanger.

As stated above, heated oil is introduced into the core portion 11 through the oil inlet pipe 19. Then, it is allowed to flow through the first oil passage 39*a* in a downward direction in FIG. 1. Then, it is allowed to flow in the core portion 11 in a meandering manner by the first and second blocking plates 31A, 31B, 31B and 33B, thereby conducting a heat exchange between the heated oil and the cooling water. Then, the cooled oil is allowed to flow from the lower end of the second oil passage 39*b* in FIG. 1 into the through hole 23 through the oil passage 25*a* and then into the oil outlet pipe 45.

As shown by arrows in FIG. 2, cooling water is introduced into the core portion 11 through the cooling water inlet pipe 27, and then is allowed to flow through the cooling water passage 40*b*. Each cooling water chamber 35 is filled with the cooling water to conduct a heat exchange between the heated oil and the cooling water. Then, the cooling water is allowed to flow out of the core portion 11 from the cooling water passage 40*a* into the cooling water outlet pipe 29.

As shown in FIG. 1, the first heat exchanger is characterized in that the oil outlet pipe 45 is connected to the through hole 23 formed at a central portion of the core portion 11. Therefore, it is possible to assuredly turn the oil flow direction without inserting a pipe member deep into the core portion 11. Thus, the first heat exchanger is very simple in piping structure. For the purpose of reinforcing the core portion 11, it is provided with the reinforcing member 21 at its central portion. This reinforcing member 21 collaterally provides the through hole 23. In the first heat exchanger, the through hole 23 is effectively used as a so-called oil outlet passage for guiding the cooled oil toward the outside of the core portion. It is needless to say that the through hole 23 can effectively be used as a so-called oil inlet passage for guiding the heated oil toward the inside of the core portion when the oil flow direction is the opposite to that shown in FIG. 1.

Figure 6:
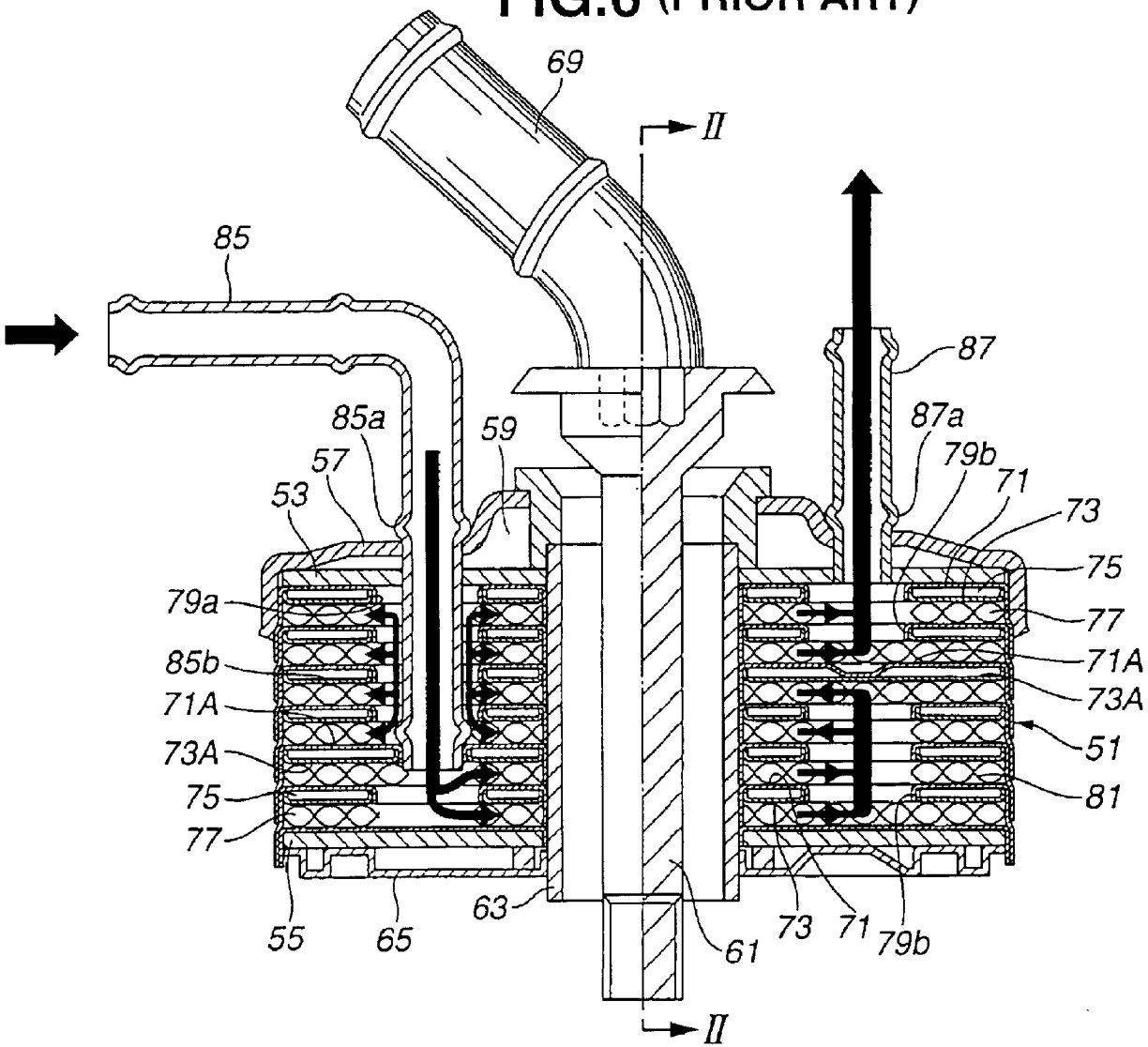
FIG.6 (PRIOR ART)
FIG. 6 is a view similar to FIG. 1, but showing a conventional heat exchanger.
Figure 7:
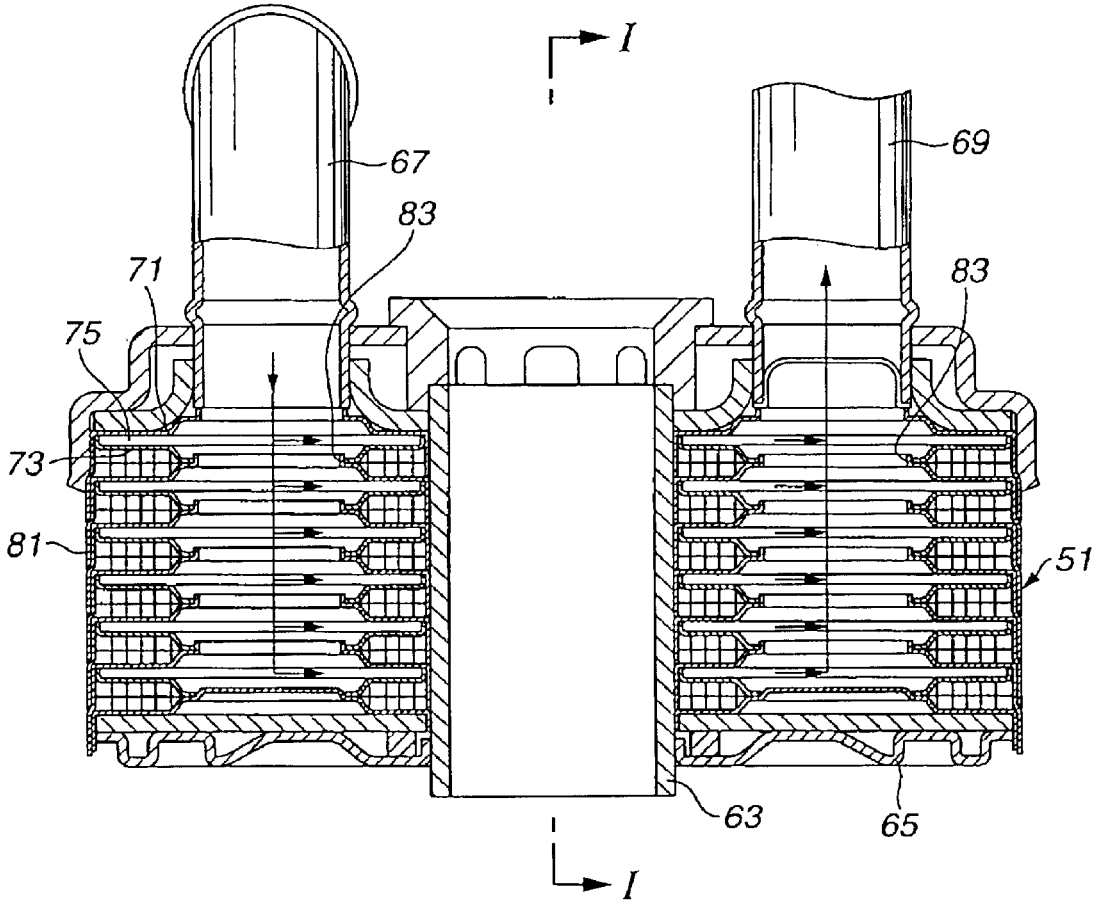
FIG.7 (PRIOR ART)
FIG. 7 is a view similar to FIG. 2, but showing the conventional heat exchanger.
Figure 8:
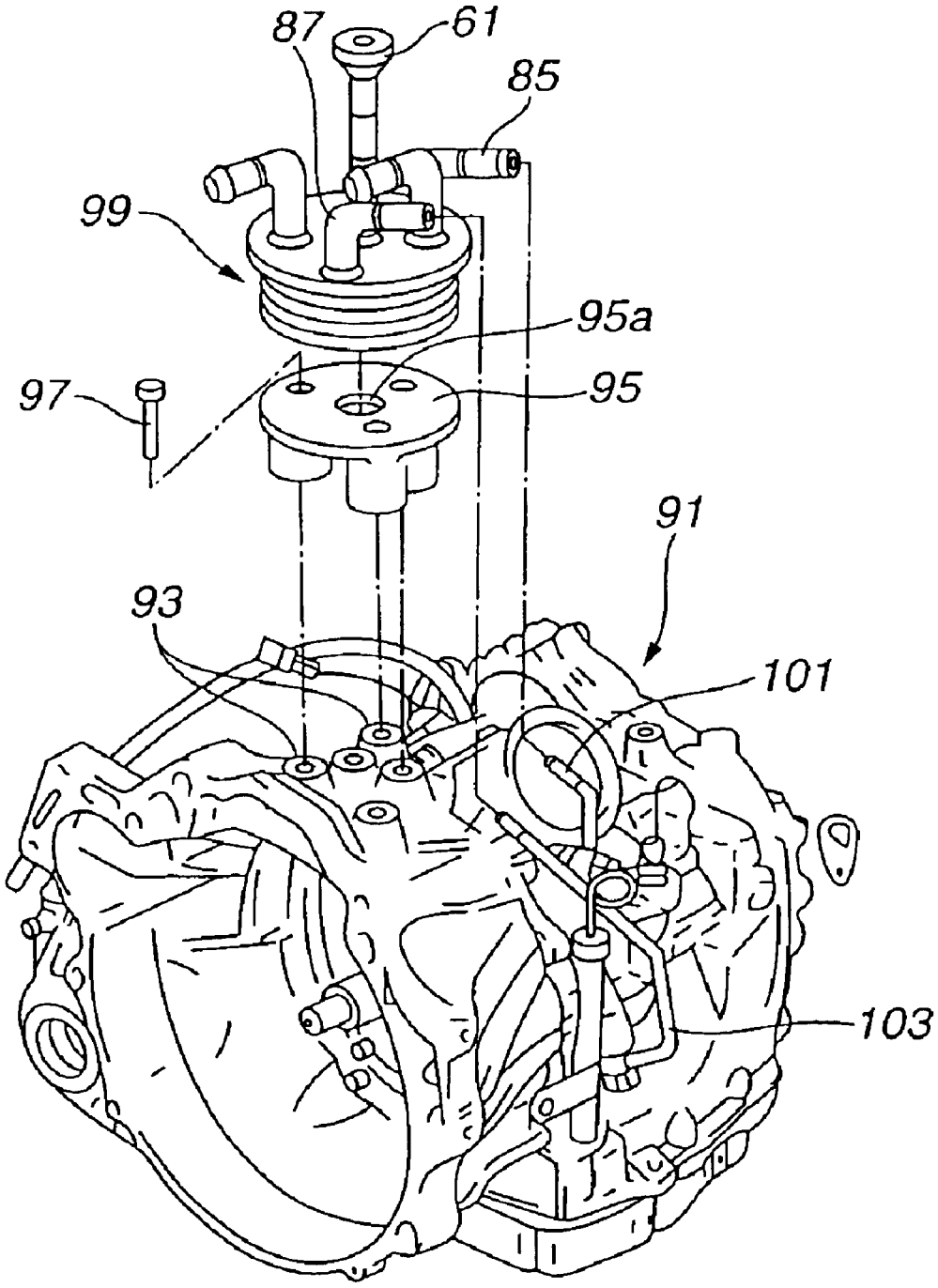
FIG.8 (PRIOR ART)
FIG. 8 is a perspective exploded view showing a condition in which the conventional heat exchanger is attached to an automatic transmission.

As stated above, the oil outlet pipe 45 is connected to the through hole 23 formed at a central portion of the core portion 11. Therefore, the distance between the oil inlet pipe 19 and the oil outlet pipe 45 is substantially shorter than that shown in FIG. 6. With this, it becomes unnecessary to provide excessive pipes for their connections to the oil inlet pipe 19 and the oil outlet pipe 45.

The cover member 25 has the oil passage 25*a* and the attaching portions 25*c* formed monolithically. This can prevent the increase of the number of parts for producing the first heat exchanger.

Figure 5:
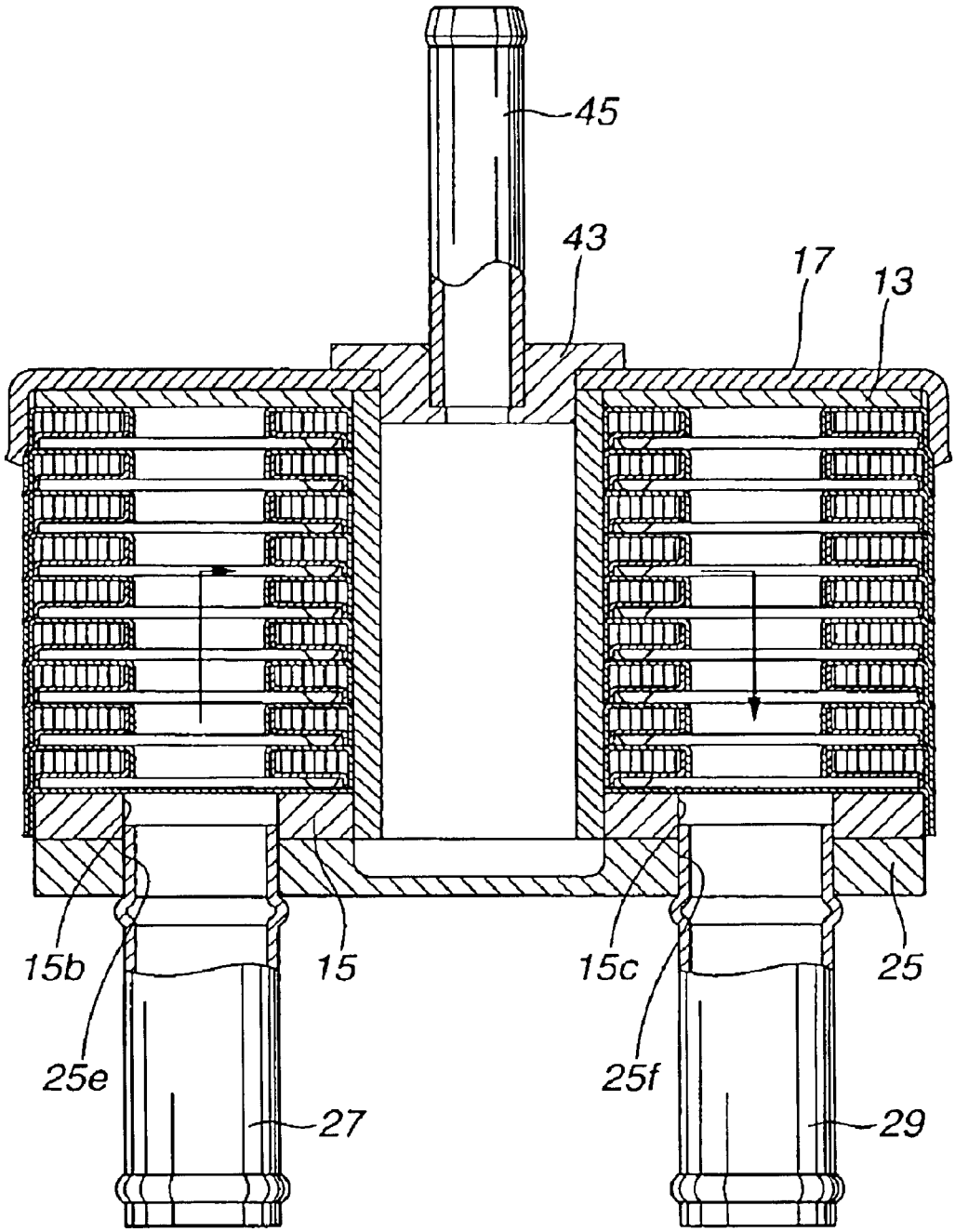
FIG. 5 is a view similar to FIG. 2, but showing a second heat exchanger according to a second embodiment of the present invention.

FIG. 5 shows a second heat exchanger according to a second embodiment of the present invention. The second heat exchanger is substantially the same as the first heat exchanger except that the cooling water inlet and outlet pipes 27 and 29 are disposed on a second side of the core portion 11 (opposite to that of FIG. 2). Thus, the second heat exchanger is freer than the first heat exchanger in terms of layout of the cooling water inlet and outlet pipes. In the second heat exchanger, the lower reinforcing plate 15 is formed with through holes 15*b* and 15*c* for respectively receiving the cooling water inlet and outlet pipes 27 and 29. Similarly, the cover member 25 is also formed with through holes 25*e* and 25*f* for that.

The invention is not limited to the above-mentioned embodiments. For example, the oil flow direction (shown by the arrows of FIG. 1) can be opposite. In fact, it is optional to introduce the heated oil into the through hole 23 through the pipe 45. With this, the oil is allowed to flow into the second oil passage 39*b* through the oil passage 25*a*. Then, it is allowed to flow in a meandering manner by the provision of the first and second blocking plates 31A, 31B, 33A and 33B, thereby conducting a heat exchange between the heated oil and the cooling water. Then, the cooled oil is allowed to flow out of the core portion 11 from the first oil passage 39*a* into the pipe 43.

The entire disclosure of Japanese Patent Application No. 2001-75468 filed on Mar. 16, 2001, including specification, drawings, claims and summary, is incorporated herein by reference in its entirety.

What is claimed is:

1. A heat exchanger for cooling oil with water, comprising:

a plurality of plates stacked together to form a core portion of said heat exchanger such that a plurality of oil chambers for receiving the oil and a plurality of water chambers for receiving the water are alternately formed between said plates, said water chambers being communicated with each other through first and second water passages;

a first wall portion for defining a through hole in said core portion, said through hole allowing the oil to flow therethrough and having first and second ends at first and second sides of said core portion respectively, said first end being one of an inlet for allowing the oil to flow into said core portion and an outlet for allowing the oil to flow out of said core portion;

a second wall portion for defining a first oil passage in said core portion, said first oil passage extending between said first and second sides of said core portion to communicate with said oil chambers, said first oil passage having first and second ends at said first and second sides of said core portion respectively, said first end of said first oil passage being the other of said inlet and said outlet;

a third wall portion for defining a second oil passage in said core portion, said second oil passage extending between said first and second sides of said core portion to communicate with said oil chambers; said second oil passage having first and second ends at said first and second sides of said core portion respectively;

a first blocking plate for blocking a part of said first and second oil passages such that a flow of the oil is turned from one of said first and second oil passages to the other of said first and second oil passages; and a first cover member for sealingly covering said second side of said core portion, said first cover member having an oil passage extending between said second end of said through hole and at least one of said second end of said first oil passage and said second end of said second oil passage, wherein a completely void space is provided between said first and second ends of said though hole.

2. A heat exchanger according to claim 1, further comprising a second cover member for sealingly covering said first side of said core portion, said second cover member comprising (a) first to fourth through openings at respective positions corresponding to said through hole, said first oil passage and said first and second water passages and (b) a wall portion for closing said first end of said second oil passage.

3. A heat exchanger according to claim 1, wherein said first cover member has an attaching portion for attaching said heat exchanger to another member.

4. A heat exchanger according to claim 1, wherein said first and second water passages have at said first side of said core portion (a) an inlet for allowing the water to flow into said core portion and (b) an outlet for allowing the water to flow out of said core portion, respectively.

5. A heat exchanger according to claim 1, wherein said first and second water passages have at said second side of said core portion (a) an inlet for allowing the water to flow into said core portion and (b) an outlet for allowing the water to flow out of said core portion, respectively.

6. A heat exchanger according to claim 1, wherein said heat exchanger comprises (a) said first blocking plate for blocking a part of said first oil passage and (b) a second blocking plate for blocking a part of said second oil passage, wherein said first blocking plate is at a position closer to said first side of said core portion than said second blocking plate is such that a meandering flow of the oil is provided in said core portion.

7. A heat exchanger according to claim 1, wherein said through hole is formed at a central portion of said core portion.

8. A heat exchanger according to claim 1, wherein said plates comprise first and second plates alternately stacked together to form said core portion, each of said first plates having first and second flanges respectively providing said second and third wall portions.

9. A heat exchanger according to claim 1, further comprising a cylindrical reinforcing member providing said first wall portion.

10. A heat exchanger according to claim 7, wherein said first and second oil passages are symmetrically arranged about said through hole.

11. A heat exchanger according to claim 1, wherein said oil passage of said first cover member extends between said second end of said through hole and said second end of said second oil passage.

12. A heat exchanger according to claim 11, wherein said oil passage of said first cover member is formed by way of a depression in a portion of said first cover member that extends directly beneath said second oil passage and said through hole.

13. A heat exchanger according to claim 6, wherein said second wall portion comprises a first region provided proximate to said first side of said core portion and disposed above said first blocking plates, and a second region provided proximate to said second side of said core portion and disposed below said first blocking plates, wherein said third wall portion comprises a first region provided proximate to said first side of said core portion and disposed above said second blocking plates, and a second region provided proximate to said second side of said core portion and disposed below said second blocking plates, wherein oil entering into said core portion arrives into the first region of said second wall portion, is then redirected to the first region of said third wall portion by way of a first one of said first blocking plate, and is then redirected to the second region of said second wall portion by way of said second blocking plate, and is then redirected to the second region of said third wall portion by way of a second one of said first blocking plates.

14. A heat exchanger according to claim 1, further comprising an oil inlet pipe that is coupled to the through hole of said first wall portion, wherein an oil outlet end of said oil inlet pipe for providing oil to said core portion is disposed against said first end of said core portion, and wherein the oil outlet end of said oil inlet pipe is located above all of said oil chambers and all of said water chambers of said heat exchanger.

15. A heat exchanger according to claim 1, wherein said first end of said through hole is an inlet for allowing the oil to flow into said core portion and said second end of said through hole is an outlet for allowing the oil to flow out of said core portion, and wherein said second end of said through hole is connected to an oil outlet pipe such that said oil outlet pipe does not extend into said through hole.

16. A heat exchanger according to claim 1, wherein said second end of said through hole is an inlet for allowing the oil to flow into said core portion and said first end of said through hole is an outlet for allowing the oil to flow out of said core portion.

17. A heat exchanger according to claim 1, wherein oil is introduced into an upper end of said core portion and thereby into said first oil passage, wherein said oil then flows into said second oil passage and thereby into a lower end of said core portion, and wherein said oil then flows through said oil passage of said first cover member and into said through hole, and then flows through said through hole back to the upper end of said core portion.

* * * * *